US008691741B2

(12) United States Patent
Ishizuka et al.

(10) Patent No.: US 8,691,741 B2
(45) Date of Patent: Apr. 8, 2014

(54) LIQUID DETERGENT COMPOSITION

(75) Inventors: Hitoshi Ishizuka, Wakayama (JP); Kyoko Okada, Wakayama (JP); Yoshiyuki Komatsu, Wakayama (JP); Toshio Miyake, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/257,509

(22) PCT Filed: Apr. 16, 2010

(86) PCT No.: PCT/JP2010/056801

§ 371 (c)(1), (2), (4) Date: Sep. 19, 2011

(87) PCT Pub. No.: WO2010/119935

PCT Pub. Date: Oct. 21, 2010

(65) Prior Publication Data

US 2012/0010118 A1 Jan. 12, 2012

(30) Foreign Application Priority Data

Apr. 17, 2009 (JP) ..... 2009-101166

(51) Int. Cl.

*C11D 1/00* (2006.01)
*C11D 1/722* (2006.01)
*C11D 1/62* (2006.01)

(52) U.S. Cl.

USPC ..... 510/329; 510/330; 510/336; 510/337; 510/351; 510/352; 510/356; 510/357; 510/499; 510/504; 510/505; 510/506

(58) Field of Classification Search

USPC ..... 510/329, 330, 336, 337, 351, 352, 356, 510/357, 499, 504, 505, 506; 8/137

See application file for complete search history.

(56) References Cited

U.S. PATENT DOCUMENTS

| | | | | |
|---|---|---|---|---|
| 5,990,066 | A * | 11/1999 | Gordon et al. | 510/238 |
| 6,007,584 | A | 12/1999 | Suzuki et al. | |
| 6,048,831 | A | 4/2000 | Mori et al. | |
| 6,358,912 | B1 * | 3/2002 | Evers et al. | 510/505 |
| 6,482,793 | B1 * | 11/2002 | Gordon et al. | 510/475 |
| 6,484,735 | B1 * | 11/2002 | Gordon et al. | 134/25.2 |
| 6,701,940 | B2 * | 3/2004 | Tsibouklis et al. | 134/25.2 |
| 6,740,626 | B2 * | 5/2004 | Neumiller | 510/109 |
| 6,949,496 | B1 * | 9/2005 | Boutique et al. | 510/276 |
| 7,696,143 | B2 * | 4/2010 | McCue et al. | 510/238 |
| 7,922,828 | B2 * | 4/2011 | Smith et al. | 134/18 |
| 2003/0064905 | A1 | 4/2003 | Gohl et al. | |
| 2003/0148913 | A1 * | 8/2003 | Klinkhammer et al. | 510/421 |
| 2004/0045099 | A1 * | 3/2004 | Kuzuhara et al. | 8/405 |
| 2006/0040837 | A1 * | 2/2006 | Frantz et al. | 510/130 |
| 2011/0224126 | A1 | 9/2011 | Miyake et al. | |

FOREIGN PATENT DOCUMENTS

| | | |
|---|---|---|
| CN | 1533426 A | 9/2004 |
| JP | 1-132691 | 5/1989 |
| JP | 8-157867 | 6/1996 |
| JP | 9-255989 | 9/1997 |
| JP | 10-195499 | 7/1998 |
| JP | 10 195499 | 7/1998 |
| JP | 11 131091 | 5/1999 |
| JP | 11-217585 | 8/1999 |
| JP | 11-241094 | 9/1999 |
| JP | 11-315299 | 11/1999 |
| JP | 2008-7705 | 1/2008 |
| JP | 2008-7706 | 1/2008 |
| JP | 2008-7707 | 1/2008 |
| WO | 98 24865 | 6/1998 |
| WO | 2010 058862 | 5/2010 |

OTHER PUBLICATIONS

U.S. Appl. No. 13/322,889, filed Nov. 28, 2011, Miyake, et al.

* cited by examiner

*Primary Examiner* — Gregory R Delcotto

(74) *Attorney, Agent, or Firm* — Oblon, Spivak, McClelland, Maier & Neustadt, L.L.P.

(57) ABSTRACT

The present invention provides a liquid detergent composition containing the following components (a) to (c), wherein the total content of components (a) to (c), (a)+(b)+(c), is 40 to 90% by mass; a mass ratio of components (a) to (b), (a)/(b), is 25/75 to 90/10; and a mass ratio [(a)+(b)]/(c), is 95/5 to 70/30:

component (a): 15 to 75% by mass of a nonionic surfactant produced by adding p1 mol of ethylene oxide to a compound represented by R—OH (wherein, R represents a hydrocarbon group having 8 to 18 carbon atoms), then adding q1 mol of an alkylene oxide having 3 to 5 carbon atoms, and then adding p2 mol of ethylene oxide, wherein p1 is the number of 3 to 30, q1 is the number of 1 to 5, and p1+p2 is 14 to 50, component (b): anionic surfactant, component (c): cationic surfactant, component (d): 5 to 40% by mass of water-miscible organic solvent.

19 Claims, No Drawings

LIQUID DETERGENT COMPOSITION

FIELD OF THE INVENTION

The present invention relates to a liquid detergent composition, and particularly to a liquid detergent composition for fiber products such as clothing materials.

BACKGROUND OF THE INVENTION

Recent increase in the environmental consciousness leads strong desire for the development of a detergent with low environmental load. A detergent having higher concentration of a cleaning component than that of conventional detergent, or a concentrated detergent, appears as being very effective for decreasing its own size to reduce an amount of resin used for container, a transportation cost, and a waste after use, resulting in reduction of loads on the environment.

A common liquid detergent however has a problem of seriously detracted usability due to thickening or gelation when it contains an increased amount of a surfactant as a cleaning component (e.g., 40% by mass or more). This is because the surfactant at high concentration forms a highly viscous phase such as of liquid crystal and crystal in the detergent composition. To provide a composition having a decreased viscosity, there is a method of adding a large amount of solvent to such a detergent composition containing a surfactant at high concentration for reducing a viscosity. The method however has problems of increased risk of the presence of a flash point in the composition and of damaging materials such as a container and a laundry machine. In addition, since the solvent does not contribute as a cleaning component, addition of a large amount of the solvent is not desirable in terms of formulation cost. The composition having an increased concentration of a surfactant has further problems in solubility and stability such as tendency of solidification of the composition during storage at low temperature. There is also a known liquid detergent having softening effects by blending cationic surfactant in the detergent. The detergent composition however has more serious problems in solubility and stability when it contains anionic surfactant and cationic surfactant together.

JP-A2008-7705, JP-A2008-7706, and JP-A2008-7707 describe concentrated liquid detergent compositions containing a specific nonionic surfactant.

JP-A11-217585 and JP-A01-132691 describe softening liquid detergents containing quaternary ammonium salt.

JP-A08-157867 describes a concentrated liquid detergent composition containing nonionic surfactant produced by adding ethylene oxide and propylene oxide to higher alcohol and specific solvent. In the text and Examples of the patent, exemplified as a preferred nonionic surfactant is ethylene oxide/propylene oxide block adduct produced by adding ethylene oxide and then propylene oxide.

JP-A09-255989 and JP-A11-241094 describe liquid detergents having a good rinsing property and good softening effect, comprising nonionic surfactant produced by adding propylene oxide and ethylene oxide to higher alcohol, anionic surfactant and cationic surfactant.

JP-A11-315299 describes a liquid detergent having good detergency and softening effect, containing nonionic surfactant having alkyl or alkenyl group of 8 to 20 carbon atoms and a sequence of polyethyleneoxy-polypropyleneoxy-polyethyleneoxy group added to the alkyl or alkenyl group in this order, alkylbenezenesulfonate salt, and a specific cationic surfactant.

SUMMARY OF THE INVENTION

The present invention relates to a liquid detergent composition containing the following components (a) to (c), wherein the total content of components (a) to (c), (a)+(b)+(c), is 40 to 90% by mass; a mass ratio of components (a) to (b), (a)/(b), is 25/75 to 90/10; and a mass ratio [(a)+(b)]/(c), is 95/5 to 70/30:

component (a): 15 to 75% by mass of a nonionic surfactant produced by adding p1 mol of ethylene oxide to a compound represented by R—OH (wherein, R represents hydrocarbon group having 8 to 18 carbon atoms), then adding q1 mol of alkylene oxide having 3 to 5 carbon atoms, and then adding p2 mol of ethylene oxide, wherein p1 is the number of 3 to 30, q1 is the number of 1 to 5, and p1+p2 is 14 to 50, component (b): anionic surfactant, component (c): cationic surfactant, component (d): 5 to 40% by mass of water-miscible organic solvent.

The present invention also relates to a method for washing a fiber product and in particular a clothing material with the liquid detergent composition of the present invention.

DETAILED DESCRIPTION OF THE INVENTION

Concentrated liquid detergent compositions of JP-A2008-7705, JP-A2008-7706, and JP-A2008-7707 have problems of stability at low temperature and of solubility in cold water. Liquid detergents including a softening agent of JP-A11-217585 and JP-A01-132691 still have problems of stability at low temperature and solubility and further a problem of significantly decreased detergency. The nonionic surfactant disclosed in JP-A08-157867 and JP-A09-255989 exhibits effects of preventing formation of liquid crystal and crystal, which are higher than that of usual nonionic surfactant but insufficient, and cannot fully solve the problems of stability at low temperature and of solubility in cold water. Liquid detergent compositions of JP-A11-241094 and JP-A11-315299 do not exhibit sufficient solubility in cold water in cases of the surfactant-rich system. In these detergents, quaternary ammonium salt does not efficiently attach to fabrics. There is a need for improved softening effects.

The present invention provides a liquid detergent composition comprising a surfactant at high concentration that has good detergency, good softening effect on fiber products such as clothing material, and good storage stability, and keeps its solubility by preventing gelation or the like when diluted in water.

The composition of the present invention has good stability, in particular storage stability at low temperature, good solubility, in particular solubility in cold water, as well as good softening effect and washing performance on fiber products such as clothing material, while comprising a surfactant as a cleaning component at high concentration and further comprising an anionic surfactant and a cationic surfactant.

<Component (a)>

The component (a) of the present invention is nonionic surfactant produced from a compound represented by R—OH (wherein R represents hydrocarbon group having 8 to 18 carbon atoms) by adding p1 mol of ethylene oxide, q1 mol of alkylene oxide having 3 to 5 carbon atoms, and p2 mol of ethylene oxide in this order to 1 mol of the compound. From the points of stability and detergency, R represents an alkyl or alkenyl group, preferably an alkyl group, having 8 to 18 carbon atoms, preferably having 8 to 16 carbon atoms. From the point of detergency, an oxygen atom is preferably attached to the primary carbon atom or the secondary carbon atom of R. That is, R—OH is preferably a primary or secondary alcohol. More preferably, R represents an alkyl group, and even more preferably linear alkyl group. For producing a compound having such R, preferably used as a starting material are primary alcohols derived from natural fats-and-oils and synthetic secondary alcohols. In cases of using an alcohol derived from natural fats-and-oils, R generally contains a hydrocarbon group having an even number of carbon atoms ranging from 8 to 18, having the same distribution of alkyl groups as that of natural fatty acids. In the present invention, R particularly preferably contains one or more linear alkyl groups selected from alkyl groups having 10, 12 and 14 carbon atoms. Hereinbelow, p1, p2, and q1 are addition mole numbers per mole of the compound represented by R—OH, and also referred to as average addition mole numbers.

The component (a) of the present invention can be referred to as nonionic surfactant represented by the formula (a1):

$$RO(EO)_{p1}(AO)_{q1}(EO)_{p2}H \quad (a1)$$

(wherein, R represents a hydrocarbon group, preferably an alkyl or alkenyl group, and more preferably an alkyl group, having 8 to 18 carbon atoms; EO represents an oxyethylene group; AO represents an oxyalkylene group having 3 to 5 carbon atoms; p1 and p2 each represent an average addition mole number of EO, and p1 is the number ranging from 3 to 30; q1 represents an average addition mole number of AO ranging from 1 to 5; and p1+p2 is 14 to 50.

In the component (a), the total of the average addition mole number of oxyethylene group (hereinafter, also referred to as EO group) p1 is 3 to 30, preferably 7 to 30, and more preferably 8 to 20. The average addition mole number of EO group p2 represents the number related to p1 within this range such that p1+p2 is 14 to 50, preferably 3 to 30, more preferably 7 to 30, and even more preferably 8 to 20. It is noted that p2 is naturally the number other than 0 even when p1 is not less than 14, because EO is added in an amount of p2 mol.

In the component (a), the total of average addition mole numbers of EO group, p1+p2, is 14 to 50, preferably 16 to 30, more preferably 17 to 25, and even more preferably 18 to 25. When p1+p2 is equal to or larger than the lower limit, the detergent composition has a good solubility at a low temperature, suppressed from formation of liquid crystals. The reason is considered that the hydrophilic moiety of the surfactant is sufficiently larger in size than the hydrophobic moiety of the surfactant, resulting in suppression of alignment of the surfactant. When p1+p2 is equal to or smaller than the upper limit, the detergent composition exhibits good washing performance and stability at low temperature. The component (a) having a value of p1+p2 within this range increases detergency and softening effects of the detergent composition when used together with the components (b) and (c). This shows that although a hydrophilic surfactant like the component (a) generally does not show sufficient detergency when used alone, the combined use of the components (b) and (c) provides good detergency and increased adhesion of the component (c) to a fiber product.

In the formula (a1), AO represents an oxyalkylene group (hereinafter, also referred to as AO group) having 3 to 5 carbon atoms, and an average addition mole number q1 is 1 to 5, preferably 2 to 4, and more preferably 2 to 3.

When the average addition mole number of AO group q1 is within the range from the lower limit to the higher limit, the component (a) is difficult to form liquid crystal and/or crystal and achieves good solubility and stability at low temperature, resulting in good washing performance. Adding an alkylene oxide having 3 to 5 carbon atoms provides AO group. It is known that, in one hand, a common point of AO groups has a blanched alkyl group, and on the other hand, a block of AO group exhibits lipophilicity differently from a block of EO group that forms a hydrophilic moiety. From the points of versatility and ease of subsequent addition of ethylene oxide, among AO groups, preferred is an oxyalkylene group having 3 carbon atoms, or an oxypropylene group (hereinafter also referred to as PO group). In short, AO group is preferably an oxypropylene group, and PO group accounts for 7 to 20% by mol of the total mole number of PO and EO groups. In other words, an alkylene oxide having 3 to 5 carbon atoms to be added to a compound represented by R—OH after addition of ethylene oxide to the compound is preferably propylene oxide, and a proportion of propylene oxide is preferably 7 to 20% by mol of the total amount of propylene oxide and ethylene oxide added before and after addition of propylene oxide.

In the component (a) of the present invention, average addition mole numbers of ethylene oxide p1 and p2 preferably satisfies p1/(p1+p2)=0.2 to 0.8, and more preferably 0.3 to 0.7. When p1/(p1+p2) is 0.2 or larger, the component (a) exhibits increased ability of preventing formation of liquid crystal and/or crystal to provide better solubility and stability at low temperature. When p1/(p1+p2) is 0.8 or smaller, the component (a) exhibits increased ability of preventing formation of crystal to provide an improved stability at low temperature.

The component (a) has a structure such that ethylene oxide is added to R—O—, as represented by the formula (a1). Since the average addition mole number p1 is not less than 3, compounds having RO— linked to EO group dominates the component (a). The component (a) also has an end structure of -EO—H as represented by the formula (a1). Since the average addition mole number p2 satisfies p1+p2 ranging from 14 to 50, compounds having -EO—H at the terminal of the component (a). In the present invention, compounds having R—O— linked to EO group (hereinafter, also referred to as component (a-i)) preferably accounts for not less than 75% by mol, and more preferably 80% by mol or more of nonionic surfactants composing the formula (a1), and compounds having an end structure of -EO—H (hereinafter, also referred to as component (a-ii)) preferably accounts for not less than 70% by mol, and more preferably 80% by mol or more of nonionic surfactants composing the formula (a1). When the component (a-i) accounts for not less than 75% by mol, the component (a) exhibits increased ability of preventing formation of liquid crystal and/or crystal to provide good solubility and stability at low temperature. When the component (a-ii) accounts for not less than 70% by mol, the component (a) exhibits increased ability of preventing formation of crystal to provide good stability at low temperature. In the present invention, proportions of the components (a-i) and (a-ii) can be quantitatively measured by $C^{13}$-NMR.

The present invention is characterized by combined use of the component (a), anionic surfactant as the component (b) described below, and cationic surfactant as the component (c) at specific ratios of (a) to (b) and (c) to (a) and (b) and addition of water-miscible organic solvent as the component (d) in a liquid detergent composition comprising surfactants at high concentration in total, or a concentration of not less than 40% by mass, and more particularly not less than 50% by mass. By these characteristics, the composition of the present invention succeeds to achieve good softening effects and detergency, be stable during storage at a low temperature, prevented from difficulty in dissolving in water due to gelation. The prevention is largely due to the component (a). The present invention lies in the finding that the component (a) can reduce an area of liquid crystal phase in the three-component phase diagram of water-surfactant-solvent. The component (a) used in the present invention has specified average addition mole numbers of EO and AO groups. These numbers are different from nonionic surfactants of ethylene oxide adducts generally used in domestic laundry detergents in the points of a large addition mole number of ethylene oxide in the total and the symmetry of mole numbers of ethylene oxide. In general, for producing a liquid detergent comprising nonionic surfactant as a main base material, from the point of detergency, among known nonionic surfactants, often used is polyoxyethylene alkyl ether having an average addition mole number of ethylene oxide of not more than 14. When it comes to laundry detergents, an average ethylene oxide addition mole number (hereinafter, also referred to as average EO addition mole number) suitable for detergency is generally about 3 to 12. However, from the point of preventing gelation in diluting in water, such nonionic surfactant conventionally used is often limited in the concentration when used in the concentrated surfactant system. The present invention has solved the problems of stability at low temperature, softening effects, and gelation in dissolving in cold water by specifying a proportion of the compound having an average EO addition mole number of not less than 14 and comprising a hydrophobic oxyalkylene group, or an oxyalkylene group having 3 to 5 carbon atoms, preferably an oxypropylene group between EO groups (including polyoxyethylene groups), adding the component (b) described below at such mass ratio as that the components (a) to (b), (a)/(b), is 25/75 to 90/10, and adding the component (c) at such mass ratio as that the total of the components (a) and (b) to (c), [(a)+(b)]/(c), is 95/5 to 70/30. Further, addition of ethylene oxide, propylene oxide, and ethylene oxide to R—OH in this order and at specific average addition mole numbers is thought to provide the component (a) comprising the components (a-i) and (a-ii) in increased proportion. This increased proportion may also contribute to enhance effects of the present invention by limiting crystal phase and/or liquid crystal phase, or the like.

In production of the component (a), examples of a catalyst used for alkoxylation of R—OH include base catalysts or acid catalysts. From the point particularly of production cost, base catalysts are preferably used, and potassium hydroxide is more preferably used as a base.

An example of production conditions for using potassium hydroxide as a catalyst is described below. First, to a saturated or unsaturated higher alcohol (compound represented by R—OH) having 8 to 18 carbon atoms as a starting material is added potassium hydroxide. After a reaction system is substituted with nitrogen, dehydration is performed for 30 minutes to 1 hour at 100 to 110° C. under 1 to 7 kPa. Addition of ethylene oxide is then performed at 100 to 170° C. under 0.3 to 0.6 MPa, followed by addition of alkylene oxide having 3 to 5 carbon atoms, preferably propylene oxide at 100 to 150° C. under 0.3 to 0.7 MPa. Addition of ethylene oxide is again performed at 100 to 170° C. under 0.3 to 0.7 MPa. An acidic agent (e.g., acetic acid, lactic acid, and glycolic acid) is added to the reaction in an equimolar amount to potassium hydroxide added for neutralization to obtain a product. Respective amounts of ethylene oxide and an amount of alkylene oxide AO having 3 to 5 carbon atoms are selected so as to satisfy conditions of average numbers p1, p2, and q1 of the composition, according to a mole number of the starting alcohol.

From the viewpoint of washing performance, the liquid detergent composition of the present invention contains the component (a) in an amount of 15 to 75% by mass, more preferably 25 to 60% by mass, and even more preferably 30 to 50% by mass.

<Component (b)>

The liquid detergent composition of the present invention contains (b) anionic surfactant. A content of the component (b) is required to satisfy the ratio described below in relation to the component (a). The component (b) not only acts as a cleaning component but also increases stability and solubility through a combination with the component (a) at the specific ratio. The reason may be that the presence of molecules of the component (b) among molecules of the component (a) prevents surfactant molecules from aligning by electric repulsion of an anion group of the component (b), resulting in prevention of formation of liquid crystal and/or crystal.

For increasing detergency, the component (b) preferably comprising anionic surfactant selected from (b-1) carboxylate anionic surfactants [hereinafter, referred to as component (b-1)]; and (b-2) sulfonic acid and sulfate ester anionic surfactants [hereinafter, referred to as component (b-2)].

From the viewpoint of stability at low temperature, components (b-1) and (b-2) are preferably present at a mass ratio of (b-1)/(b-2) is 5/95 to 40/60, and more preferably (b-1)/(b-2) is 10/90 to 30/70.

Examples of the component (b-1) include the following (b-1-1) and (b-1-2). Examples of the component (b-2) include the following (b-2-1), (b-2-2), and (b-2-3). From the points of washing performance, stability, and solubility, the component (b) preferably contains (b-1-1), (b-2-1), and (b-2-2), and more preferably (b-2-1). In cases of comprising (b-1-1) as a foaming modifier or a dispersing agent for mud, from the point of stability at low temperature, an amount of (b-1-1) in the component (b) is preferably 1 to 30% by mass, and more preferably 1 to 20% by mass.

(b-1-1) fatty acid salt having 8 to 20 carbon atoms on an average.

(b-1-2) polyoxyethylene alkyl ether carboxylic acid salt having an average addition mole number of 1 to 5, wherein the salt contains an alkyl group derived from a liner primary or secondary alcohol having 10 to 20 carbon atoms on an average or an alkyl group derived from a branched alcohol, and one or two of oxyethylene groups each may be an oxypropylene group.

(b-2-1) alkylbenzenesulfonate comprising an alkyl group having 10 to 20 carbon atoms on an average (b-2-2) polyoxyethylene alkyl ether sulfuric acid ester salt having an average addition mole number of 1 to 5, wherein the salt contains an alkyl group derived from a liner primary or secondary alcohol having 10 to 20 carbon atoms on an average or an alkyl group derived from a branched alcohol, and one or two of oxyethylene groups each may be an oxypropylene group.

(b-2-3) alkyl- or alkenylsulfuric acid ester salt comprising an alkyl or alkenyl group having 10 to 20 carbon atoms on an average.

In (b-1-1), an average carbon number is 8 to 20 and preferably 10 to 16.

In (b-2-1) and (b-2-2), an average carbon number of an alkyl group is 10 to 20 and preferably 10 to 16.

Examples of the salt constructing the component (b) include alkaline metal salts such as sodium and potassium, alkanolamine salts, and alkaline earth metal salts such as magnesium and calcium. Particularly from the point of stability, alkanolamine salts are preferred. The anionic surfactant may be added in an acid form to the liquid detergent and neutralized with an alkali in the liquid detergent. In the present invention, the component (b) is preferably in an alkanolamine salt form, or added in an acid form and then neutralized with an alkanolamine [that used as an alkaline agent of the component (f) described below]. Metal counter ions such as alkaline metal and alkaline earth metal ions may be contained in the composition through the production of the component (a) or as a salt of a sequestering agent or an anionic compound, but an amount thereof is preferably low, substantially not more than 5% by mass, more preferably not more than 3%, by mass, and even more preferably not more than 1% by mass. The alkanolamine is preferably monoethanolamine.

<Component (c)>

The liquid detergent composition of the present invention contains cationic surfactant for imparting softening effects on fabrics as the component (c).

The cationic surfactant as the component (c) is preferably quaternary ammonium and/or tertiary amine surfactant, and more preferably quaternary ammonium and/or tertiary amine surfactant comprising one hydrocarbon group having 6 to 22 carbon atoms which may be interrupted by an ether bond, a (poly)oxyalkylene group, an ester group, or an amide group. Specific example of the preferred surfactant is quaternary ammonium salt represented by the formula (c-1) (hereinafter, referred to as component (c-1)) below.

[Chemical formula 1]

(c-1)

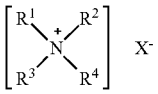

(wherein, $R^1$ represents a hydrocarbon group, preferably a linear alkyl or alkenyl group, having 6 to 22 carbon atoms, and may contain $-(AO)_s-$; AO represents an oxyethylene or oxypropylene group; s represents an average addition mole number of AO ranging from 0.1 to 10; $R^2$, $R^3$, and $R^4$ each independently represents a methyl group, an ethyl group, a benzyl group, or a hydroxyalkyl group having 1 to 3 carbon atoms; and X represents a halogen atom, $CH_3SO_4$, or $CH_3CH_2SO_4$.)

Combined use of the cationic surfactant as the component (c) with the anionic surfactant as the component (b) had concerns about adverse effects on enhancement of detergency by the component (b) and softening effects on fabrics by the component (c) and on effects of preventing formation of liquid crystal and/or crystal by combined use of the components (a) and (b). However, in the present invention, use of the component (c) at a specific ratio allows the detergent composition to achieve special effects, such as detergency of other surfactants and efficient softening effects of the component (c), when the detergent composition is diluted in a washing medium. The component (c) generally shows less softening effects when used together with nonionic surfactant and/or anionic surfactant than effects achieved by single use of the component (c). This is because dispersion of the component (c) takes place in the state included in the micelle of other surfactants as well as formation of a complex with the anionic surfactant in water to decrease adhesion of the component (c) to fabrics. The present invention solves these problems.

For the cationic surfactant as the component (c-1), the following (c-1-1) to (c-1-4) can be used, for example. The component (c-1) preferably contains a compound selected from (c-1-1) and (c-1-3). When the component (c-1) contains (c-1-1), (c-1-1) preferably accounts for not less than 50% by mass, and more preferably 60% by mass of the component (c-1). In the quaternary ammonium salt of the formula (c-1), an average carbon number of $R^1$ is preferably 8 to 20, more preferably 10 to 18, and even more preferably 10 to 16.

(c-1-1) ammonium salt in which $R^1$ represents a linear alkyl group having 6 to 22 carbon atoms and $R^2$ to $R^4$ each represent an alkyl group having 1 to 3 carbon atoms.

(c-1-2) ammonium salt in which $R^1$ represents a branched alkyl group having 6 to 22 carbon atoms and $R^2$ to $R^4$ each represent an alkyl group having 1 to 3 carbon atoms.

(c-1-3) ammonium salt in which $R^1$ represents a linear alkyl group having 6 to 22 carbon atoms, $R^2$ represents a benzyl group, and $R^3$ and $R^4$ each represent an alkyl group having 1 to 3 carbon atoms.

(c-1-4) ammonium salt in which $R^1$ represents a linear alkyl group having 6 to 22 carbon atoms and $-(AO)_s-$, s represents 1 to 5, and $R^2$ to $R^4$ each represent an alkyl group having 1 to 3 carbon atoms.

From the point of detergency, in the liquid detergent composition of the present invention, the total of contents of the components (a) and (b) and (c), (a)+(b)+(c), is 40 to 90% by mass, preferably 45 to 80% by mass, and more preferably 50 to 70% by mass. Since the anionic surfactant as the component (b) varies its mass according to a molecular weight of a salt formed, in the present invention, the mass of the anionic surfactant in an acid form, supposing a hydrogen atom as the counter ion, is the mass of the component (b). The cationic surfactant as the component (c) also varies its mass according to a molecular weight of a salt formed, and the present invention considers amass excluding the counter anion as the mass of the component (c).

From the viewpoints of washing performance, solubility, and stability, in the liquid detergent composition of the present invention, a mass ratio (a)/(b) is 25/75 to 90/10, preferably 50/50 to 90/10, and more preferably 60/40 to 90/10. From the point of detergency, a ratio of the component (a) is not less than the lower limit, and from the points of solubility and stability not more than the upper limit. Combined use of the components (a) and (b) can prevent the composition from forming liquid crystal to increase solubility. From the viewpoint of balance between softening performance and cleaning ratio, a mass ratio of the total of the components (a) and (b) to the component (c), [(a)+(b)]/(c), is 95/5 to 70/30, preferably 94/6 to 75/25, more preferably 93/7 to 80/20, even more preferably 92/8 to 75/25, and still even more preferably 90/10 to 80/20. From the viewpoint of softening effects on fabrics, a mass ratio of the components (b) to (c), (b)/(c), is preferably 20/80 to 80/20. The lower limit is preferably not less than 40/60, and the upper limit is preferably not more than 70/30. When the component (c-1) is used, the preferred acceptable range varies according to a chain length of $R^1$. When a carbon number of $R^1$ is 8 to 12, the acceptable upper limit elevates and the preferred acceptable upper limit of a mass ratio (b)/(c) is 80/20. When a carbon number of $R^1$ is 14 to 18, the acceptable lower limit declines and the preferred acceptable lower limit of a mass ratio (b)/(c) is 20/80.

<Component (d)>

The liquid detergent composition of the present invention contains (d) a water-miscible organic solvent in an amount of 5 to 40% by mass. As used herein, the water-miscible organic solvent refers to a solvent that dissolves in an amount of not less than 50 g in 1 L of deionized water at 25° C., or that has a solubility of not less than 50 g/L.

A content of the component (d) in the composition is 5 to 40% by mass, preferably 10 to 35% by mass, and more preferably 10 to 25% by mass. From the viewpoints of stability and solubility, a mass ratio of the total of the components (a), (b), and (c) to the component (d), [(a)+(b)+(c)]/(d), is preferably 90/10 to 65/35, more preferably 90/10 to 70/30, and more preferably 85/15 to 70/30.

The component (d) is preferably a water-miscible organic solvent having a hydroxy group and/or an ether group.

Examples of the water-miscible organic solvent include: (d-1) alkanols such as ethanol, 1-propanol, 2-propanol, and 1-butanol; (d-2) glycols such as propylene glycol, butylene glycol, and hexylene glycol; (d-3) polyglycols such as diethylene glycol, triethylene glycol, tetraethylene glycol, dipropylene glycol, and tripropylene glycol; (d-4) alkyl ethers such as diethylene glycol monomethyl ether, diethylene glycol dimethyl ether, triethylene glycol monomethyl ether, diethylene glycol monoethyl ether, diethylene glycol diethyl ether, dipropylene glycol monomethyl ether, dipropylene glycol monoethyl ether, tripropylene glycol monomethyl ether, 1-methoxy-2-propanol, 1-ethoxy-2-propanol, 1-methyl glyceryl ether, 2-methyl glyceryl ether, 1,3-dimethyl glyceryl ether, 1-ethyl glyceryl ether, 1,3-diethyl glyceryl ether, triethyl glyceryl ether, 1-pentyl glyceryl ether, 2-pentyl glyceryl ether, 1-octyl glyceryl ether, 2-ethylhexyl glyceryl ether, and diethylene glycol monobutyl ether; (d-5) aromatic ethers such as 2-phenoxyethanol, diethylene glycol monophenyl ether, triethylene glycol monophenyl ether, polyethylene glycol monophenyl ether having an average molecular weight of about 480, 2-benzyloxyethanol, and diethylene glycol monobenzyl ether. In aromatic ethers, mono-, di-, or triethylene glycol monobutyl ether may be used as a mixture of compounds having different addition mole numbers of oxyethylene group prepared by adding 1 to 3 mol of ethylene oxide to phenol. In this case, unreacted phenol is removed.

The component (d) serves as a viscosity modifier or a gelation inhibitor. It preferably contains at least one compound selected from (d-1) alkanols, (d-2) glycols, (d-4) alkyl ethers, and (d-5) aromatic ethers, and more preferably at least one compound selected from (d-2) glycols, (d-4) alkyl ethers, and (d-5) aromatic ethers. Such a component (d) more effectively achieves its effects of modifying viscosity and preventing gelation of the composition. Specific preferable examples of the at least one compound include ethanol, propylene glycol, diethylene glycol monobutyl ether, 2-phenoxyethanol (also referred to as ethylene glycol monophenyl ether), diethylene glycol monophenyl ether, and triethylene glycol monophenyl ether.

<Component (e)>

The liquid detergent composition of the present invention preferably contains water as a component (e) in an amount of 5 to 40% by mass, and more preferably 10 to 30% by mass. Water used is preferably that having no effect on the other components, including deionized water.

<Other Components>

[Component (f)]

The liquid detergent composition of the present invention can contain a surfactant other than the components (a), (b), and (c) (hereinafter, referred to as component (f)) within the range that it does not impair the effects of the present invention. Examples of the component (f) include the following (f-1) to (f-3).

(f-1) nonionic surfactant not corresponding to the component (a).

Examples of the nonionic surfactant of (f-1) include the following (f-1-1) and (f-1-2).

(f-1-1) alkylpolysaccharide surfactant represented by the formula:

$$R^{1f}—(OR^{2f})_xG_y$$

(wherein, $R^{1f}$ represents a liner or branched alkyl or alkenyl group having 8 to 18 carbon atoms; $R^{2f}$ represents an alkylene group having 2 to 4 carbon atoms; G represents a residue derived from a reducing sugar having 5 or 6 carbon atoms; x represents an average number ranging from 0 to 6; and y represents an average number ranging from 1 to 10.)

(f-1-2) a fatty acid alkanolamide and a polyhydroxyfatty acid amide (f-3) amphoteric surfactants.

Examples of the amphoteric surfactant of (f-3) include sulfo betaines and carbobetaines comprising an alkyl group having 10 to 18 carbon atoms.

A content of the component (f) in the liquid detergent composition of the present invention is preferably 0.5 to 15% by mass, and more preferably 0.5 to 10% by mass. Among the components (f), the nonionic surfactant (f-1) is preferably used in an amount such that a mass ratio of the total of the components (a) and (f-1) to (b), [(a)+(f-1)]/(b), is within the range described for (a)/(b).

[Alkaline Agent (g)]

The liquid detergent composition of the present invention preferably further contains an alkaline agent (hereinafter, referred to as component (g)). Examples of the alkaline agent include alkaline metal hydroxides, alkaline metal carbonates, and alkanolamines comprising 1 to 3 alkanol groups each having 2 to 4 carbon atoms commonly used in liquid detergents. In alkanolamines, an alkanol group is preferably a hydroxyethyl group. Other groups than the alkanol group are hydrogen atoms. An alkanolamine having a methyl group may also be used as an alkaline agent. Examples of the alkanolamine include 2-aminoethanol N-methylethanolamine, N,N-dimethylethanolamine, N,N-diethylethanolamine, diethanolamine, N-methyldiethanolamine, N-butyldiethanolamine, triethanolamine, triisopropanolamine, and isopropanolamine mixture (comprising mono-, di-, and triisopropanolamine). In the present invention, preferred are monoethanolamine and triethanolamine, and more preferred is monoethanolamine.

The component (g) can serve as a pH adjuster as described below, or as a counter salt to the component (b).

A content of the component (g) in the liquid detergent composition of the present invention is preferably 0.5 to 8% by mass, and more preferably 1 to 7% by mass, and more particularly an alkanolamine as the component (g) in an amount of 0.5 to 8% by mass, and more preferably 1 to 7% by mass.

Below, other components that can be used in the present invention will be described.

[Component (h)]

The liquid detergent composition of the present invention can further contain a chelating agent [hereinafter, referred to as component (h)]. Examples of the chelating agent include:

aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid, and djenkolic acid and salts thereof;

organic acids such as diglycolic acid, oxydisuccinic acid, carboxymethyloxysuccinic acid, citric acid, lactic acid, tartaric acid, oxalic acid, malic acid, gluconic acid, carboxymethylsuccinic acid, and carboxymethyltartaric acid and salts thereof; and others such as aminotri(methylenephosphonic acid), 1-hydroxyethylidene-1,1-diphosphonic acid, ethylenediaminetetra(methylenephosphonic acid), and diethylenetriaminepenta(methylenephosphonic acid), and alkaline metal salts and lower amine salts thereof. In the present invention, the component (h) is preferably in a salt form with an alkanolamine described in the component (b). The component (h) may be blended with the composition in an acid form and neutralized with an alkaline agent to form a salt in the composition.

A content of the component (h) in the composition is, on the assumption that the component (h) is in an acid form, preferably 0.1 to 5% by mass, more preferably 0.1 to 4% by mass, and more preferably 0.1 to 3% by mass.

The liquid detergent composition of the present invention can further contain the following components (i) to (xii) within the range that it does not impair the effects of the present invention.

(i) an anti-redeposition agent and a dispersant such as polyacrylic acid, polymaleic acid, carboxymethylcellulose, polyethylene glycol having a weight average molecular weight of 5000 or more, maleic anhydride-diisobutylene copolymer, maleic anhydride-methyl vinyl ether copolymer, maleic anhydride-vinyl acetate copolymer, naphthalenesulfonate-formalin condensate, and polymers described in claims 1 to 21 of JP-A59-62614 (p. 1 column 3 line 5 to p. 3 column 4 line 14);

(ii) a dye transfer inhibitor such as polyvinylpyrrolidone (iii) a bleach such as hydrogen peroxide, sodium percarbonate, and sodium perborate (iv) a bleach activator such as tetraacetylethylenediamine and those represented by formulae (I-2) to (I-7) in JP-A06-316700

(v) an enzyme such as cellulase, amylase, pectinase, protease, and lipase (vi) an enzyme stabilizer such as a boron compound, a calcium ion source (calcium ion-donating compound), a bihydroxy compound, and formic acid (vii) a fluorescent dye such as commercially available Tinopal CBS (trade name, Ciba Specialty Chemicals Inc.) and Whitex SA (trade name, Sumitomo Chemical Co., Ltd.)

(viii) an antioxidant such as butyl hydroxytoluene, distyrenated cresol, sodium sulfite and sodium hydrogen sulfite (ix) a solubilizing agent such as para-toluenesulfonic acid, cumenesulfonic acid, meta-xylenesulfonic acid, and a benzoate (also having effects as a preservative)

(x) a polymer for preventing gelation, in particular polypropylene glycol or polyethylene glycol having a weight average molecular weight of 600 to 5000, and more particularly 1000 to 4000 described in JP-B11-513067. A weight average molecular weight can be determined by a light scattering method with a dynamic light scattering spectrophotometer (DLS-8000 series, Otsuka Electronics Co., Ltd.)

(xi) a water-immiscible organic solvent including paraffins such as octane, decane, dodecane, and tridecane, olefins such as decene and dodecene, alkyl halides such as methylene chloride and 1,1,1-trichloroethane, and terpenes such as D-limonene.

(xii) others including a dye, a fragrance, an antimicrobial preservative, and a defoaming agent such as silicone.

Below, described are indicative concentrations of these optional components in the liquid detergent composition of the present invention, when the composition contains them. These concentrations are appropriately adjusted within the range that it does not impair the effects of the present invention. A component unsuited for the composition will be eliminated. A content of the anti-redeposition agent and a dispersant (i) is preferably 0.01 to 10% by mass. A content of the dye transfer inhibitor (ii) is preferably 0.01 to 10% by mass. A content of the bleach (iii) is preferably 0.01 to 10% by mass. A content of the bleach activator (vi) is preferably 0.01 to 10% by mass. A content of the enzyme (v) is preferably 0.001 to 2% by mass. A content of the enzyme stabilizer (vi) is preferably 0.001 to 2% by mass. A content of the fluorescent dye (vii) is preferably 0.001 to 1% by mass. A content of the antioxidant (viii) is preferably 0.01 to 2% by mass. A content of the solubilizing agent (ix) is preferably 0.1 to 2% by mass. A content of the polyalkylene glycol-based polymer for preventing gelation (x) is preferably 0.01 to 2%. A content of the water-immiscible organic solvent (xi) is preferably 0.001 to 2% by mass. The others (xii) can be contained, for example, at a known concentration.

Among these optional components, (ix), (x), and (xi) have effects on stability of the liquid detergent composition, and thus must be added with caution in carefully selected amounts.

From the points of washing performance and stability, the composition of the present invention preferably has a pH value (in accordance with JIS Z 8802, 7.2) of 5 to 11, and more preferably 6 to 10 (25° C.).

From the point of ease of handling, the liquid detergent composition of the present invention preferably has a viscosity at 20° C. of 10 to 500 mPa·s, more preferably 50 to 400 mPa·s, even more preferably 80 to 300 mPa·s, and still even more preferably 100 to 300 mPa·s. The viscosity is preferably adjusted to be within the range by using the component (d) and the solubilizing agent.

The liquid detergent composition of the present invention does not cause gelation or thickening in dilution in water. Specifically, it preferably does not occur gelation in an operation of diluting the composition of 5 to 40° C. with water of 5° C. by more than 0-time to 100-time, and more preferably provides a solution having a viscosity of not more than 1500 mPa·s at 5° C. by the operation.

The viscosity is substantially only required to be measured for a solution of a liquid detergent composition diluted by not more than 20-time. Whether the liquid detergent composition causes gelation or not can be judged by observing liquid properties of samples prepared therefrom by various dilution rates ranging from more than 0- to 20-time with deionized water. Specifically, all 19 samples having different concentrations of an increment of 5% by mass within the range shown below prepared by mixing the liquid detergent composition of 5° C. with deionized water of 5° C. preferably have a viscosity of not more than 1500 mPa·s at 5° C.

[(mass of liquid detergent composition for clothing)/(mass of liquid detergent composition for clothing+mass of deionized water)]×100=5 to 95% by mass In the present invention, a viscosity is measured with a B-type viscometer. A rotor is appropriately selected according to a viscosity. The viscosity of a liquid detergent composition or a solution thereof is measured at a rotation number of 60 r/min in 60 seconds after starting of the rotation.

The liquid detergent composition of the present invention is suitable for fiber products such as clothing materials, bedclothes, and fabrics, and particularly suitable for clothing materials.

The present invention can also disclose a method of washing a fiber product with the liquid detergent composition. For washing, there are methods of hand-washing and machine-washing with a commercial laundry machine. In any method, the present invention can achieve effects of decreasing the number of a step of rinsing or of excellent rinsing with a decreased amount of water. Examples of the laundry machine used in the method of washing of the present invention include a simple washer having only agitation blades and an inlet and an outlet of water, a washing machine having a separated dehydrating tub, so-called twin-tub washing machine, and a fully automatic washing machine (including a drum-type washing machine).

In the method of washing with an aqueous cleaning liquid (hereinafter, also referred to as washing liquid) prepared from the liquid detergent composition of the present invention, a bath ratio is preferably 3 to 40. As used herein, the bath ratio refers to as a value of a mass of an aqueous cleaning liquid divided by a mass of clothing materials. The present invention can achieve good effects even on a washing machine with a low bath ratio such as a drum-type washing machine. A bath ratio may be particularly 3 to 12, and more particularly 3 to 8.

The liquid detergent composition of the present invention can be diluted in cold water without occurring gelation and exhibits good detergency and softening performance over the range from low temperature to high temperature. The reason is largely due to a surfactant system contain the special nonionic surfactant. A temperature of the aqueous cleaning liquid thus can be 3° C. to 90° C., particularly 5° C. to 80° C., and more particularly 5° C. to 60° C. From the viewpoint of energy reduction, in the present invention, usual tap water can be used. The washing liquid can achieve good detergency and softening effects even at a low temperature of 5° C. to 15° C., for example, in winter. The washing liquid naturally provides favorable results in washing at 25° C. to 35° C. in summer. According to the present invention, since the liquid detergent composition does not require warm water for dissolving, it is also possible that the composition is dissolved in cold water to prepare an aqueous cleaning liquid, and the aqueous cleaning liquid is heated with a heater in a washing machine.

EXAMPLES

The following Examples demonstrate the present invention. Examples are intended to illustrate the present invention and not to limit the present invention.

Compositions of Examples and Comparative Examples were prepared by mixing respective components shown in Tables 1 to 4. The resultant compositions were subjected to the following evaluations. Results are shown in Tables 1 to 4.

(1) Evaluation of Detergency

Clothes with a dirty collar were prepared according to JIS K3362:1998. According to the method for evaluating detergency of a synthetic laundry detergent described in JIS K 3362:1998, liquid detergent compositions in Tables 1 to 4 were measured for detergency and compared with that of a standard detergent for judging detergency. Liquid detergent compositions in Tables 1 to 4 each were used at a concentration of 0.33 g/L. Detergency was judged according to the following rating: "double circle" for detergency superior to that of the standard, "circle" for detergency equivalent to that of the standard, and "cross" for detergency inferior to that of the standard.

(2) Evaluation of Storage Stability

In a 50 mL sample vial (No. 6 standard wide-mouth bottle, made of glass, a cylindrical shape having a diameter of 40 mm and a height of 80 mm), 40 mL of liquid detergent composition was filled, sealed with a cap, and allowed to stand for 20 days in a thermostatic chamber at 5° C. The liquid detergent composition was observed visually and judged for stability according to the following rating:

circle; a composition has a uniform liquid phase without formation of liquid crystal and/or crystal, and is good in liquid stability.

cross; formation of liquid crystal or crystal, separation, or precipitation is observed.

(3) Model Evaluation of Dissolution 19 samples of different concentrations in an increment of 5% by mass were prepared by mixing a liquid detergent composition with deionized water such that [(mass of liquid detergent composition)/(mass of liquid detergent composition+mass of deionized water)]×100=5 to 95% by mass. Samples were allowed to stand for one day at 5° C. in a thermostatic chamber. These were then measured for viscosity at 5° C. under the following conditions and judged according to the following rating. This experiment is a model test for solubility in water at 5° C.

Instrument: digital B-type viscometer (model; DV M-B) manufactured by Tokyo Keiki Inc.

Condition: 60 r/min, for 60 seconds circle; All samples have a viscosity lower than 1500 mPa·s This means that a composition does not thicken in dilution in cold water due to formation of liquid crystal and/or crystal. The composition is considered as having good solubility.

cross; Some samples have a viscosity not less than 1500 mPa·s. This means that, in some cases, a composition thickens in dilution in cold water due to formation of liquid crystal and/or crystal. The composition is considered as having insufficient solubility.

double cross; Among samples rated as "cross", some samples have a viscosity not less than 2000 mPa·s, or cannot be measured for viscosity.

(4) Evaluation of Softening Effects on Fabrics 4.5 g of nonionic surfactant (Emulgen 108 [polyoxyethylene(6)lauryl ether]; Kao Corporation), which is commonly used as a cleaning component, was pre-dissolved in 50 mL of deionized water to obtain a detergent solution. The detergent solution was further diluted 1000-time to be used to wash a commercially available cotton towel (100% cotton) (in a fully automatic washing machine (Panasonic Corporation, NA-F60E in a standard washing course under conditions of a water amount of 45 L, a bath ratio of 20, and a water temperature of 20° C.). The towel was washed three times in total in this course under the same conditions, and dried under conditions of 20° C. and 45% RH to obtain a towel for evaluation.

Towels for evaluation prepared as described above were washed with liquid detergent compositions in Tables 1 to 4 (in an fully automatic washing machine Panasonic Corporation, NA-F60E in a standard washing course under conditions of a water amount of 45 L, a bath ratio of 20, a water temperature of 20° C., a hardness of water of 4° DH, an amount of a detergent used of 0.5 g, fed from an inlet of the machine). Using a cotton towel washed with a standard composition (Attack Biogel; Kao Corporation, manufactured in 2009 January) as a standard of softness, towels washed with liquid detergent compositions in Tables 1 to 4 were evaluated for softness by ten panelists (ten women in their 20s to 40s) according to the following rating. An average of ten evaluations was ranked as follows: "double circle" for an average not less than 0.7, "circle" for not less than 0.3 and less than 0.7, "triangle" for not less than −0.3 and less than 0.3, and "cross" for less than −0.3. Results are shown in Tables 1 to 4.

Softer than the standard . . . 1-point

The same as the standard . . . 0-point

Harder than the standard . . . −1-point

TABLE 1

| | | | | Example | | | | | |
|---|---|---|---|---|---|---|---|---|---|
| | | | | 1 | 2 | 3 | 4 | 5 | 6 |
| Liquid detergent composition | Component (% by mass) | (a) | (a-1) | 37 | 37 | 37 | 37 | 37 | |
| | | | (a-2) | | | | | | 37 |
| | | | (a-3) | | | | | | |
| | | | (a-4) | | | | | | |
| | | | (a-5) | | | | | | |
| | | | (a-6) | | | | | | |
| | | (b) | (b-1-1) | 2 | 1 | 2 | 2 | 2 | 2 |
| | | | (b-2-1) | 10 | 5 | 10 | 10 | 10 | 10 |
| | | | (b-2-2) | | | | | | |
| | | (c) | (c-1-1) | 6 | | | | | 6 |
| | | | (c-1-2) | | 6 | | | | |
| | | | (c-1-3) | | | 6 | | | |
| | | | (c-1-4) | | | | 6 | | |
| | | | (c-3-1) | | | | | 6 | |
| | | (d) | (d-1) | 13 | 5 | 13 | 13 | 13 | 13 |
| | | | (d-2) | | 10 | | | | |
| | | | (d-3) | | | | | | |
| | | | (d-4) | | | | | | |
| | | (e) | Deionized water | Balance | Balance | Balance | Balance | Balance | Balance |
| | | (f) | (f-1) | | | | | | |
| | | | (f-2) | | | | | | |
| | | | (f-3) | 2.5 | 2.5 | 2.5 | 2.5 | 2.5 | 2.5 |
| | | (g) | Monoethanolamine | 3 | 3 | 3 | 3 | 3 | 3 |
| | | | Polymer (1) | | | | | | |
| | | | Fluorescent dye | | | | | | |
| | | | Enzyme | | | | | | |
| | | | Dye (1) | 0.0005 | 0.0005 | 0.0005 | 0.0005 | 0.0005 | 0.0005 |
| | | | Fragrance | 2 | 2 | 2 | 2 | 2 | 2 |
| | | | Total | 100 | 100 | 100 | 100 | 100 | 100 |
| | p1 + p2 in component (a) | | | 18 | 18 | 18 | 18 | 18 | 14 |
| | q1 in component (a) | | | 2 | 2 | 2 | 2 | 2 | 2 |
| | p1 + p2 + q1 in component (a) | | | 20 | 20 | 20 | 20 | 20 | 16 |
| | Proportion of component (a-i) in component (a) (% by mol) | | | 86 | 86 | 86 | 86 | 86 | 83 |
| | Proportion of component (a-ii) in component (a) (% by mol) | | | 92 | 92 | 92 | 92 | 92 | 87 |
| | (a) + (b) + (c) (% by mass) | | | 55 | 49 | 55 | 55 | 55 | 55 |
| | (a)/(b) (mass ratio) | | | 75.5/24.5 | 86/14 | 75.5/24.5 | 75.5/24.5 | 75.5/24.5 | 75.5/24.5 |
| | [(a) + (b)]/(c) (mass ratio) | | | 89/11 | 88/12 | 89/11 | 89/11 | 89/11 | 89/11 |
| | (1) Evaluation of detergency | | | ◎ | ○ | ◎ | ◎ | ○ | ◎ |
| | (2) Evaluation of storage stability | | | ○ | ○ | ○ | ○ | ○ | ○ |
| | (3) Model evaluation of dissolution | | | ○ | ○ | ○ | ○ | ○ | ○ |
| | (4) Evaluation of softening effect on fabric | | | ◎ | ◎ | ◎ | ◎ | ◎ | ◎ |

TABLE 2

| | | | | Example | | | | | | |
|---|---|---|---|---|---|---|---|---|---|---|
| | | | | 7 | 8 | 9 | 10 | 11 | 12 | 13 |
| Liquid detergent composition | Component (% by mass) | (a) | (a-1) | | | | | 30 | 55 | 37 |
| | | | (a-2) | | | | | | | |
| | | | (a-3) | 37 | | | | | | |
| | | | (a-4) | | 37 | | | | | |
| | | | (a-5) | | | 37 | | | | |
| | | | (a-6) | | | | 40 | | | |
| | | (b) | (b-1-1) | 2 | 2 | 2 | 2 | 2 | 2 | 1 |
| | | | (b-2-1) | 10 | 10 | 10 | 8 | 18 | 8 | 3 |
| | | | (b-2-2) | | | | 2 | | | |
| | | (c) | (c-1-1) | 6 | 6 | 6 | 2 | 6 | 6 | |
| | | | (c-1-2) | | | | | | | 10 |
| | | | (c-1-3) | | | | 2 | | | |
| | | | (c-1-4) | | | | 2 | | | |
| | | | (c-3-1) | | | | | | | |
| | | (d) | (d-1) | 13 | 13 | 13 | 5 | 13 | 15 | 15 |
| | | | (d-2) | | | | 2 | | | |
| | | | (d-3) | | | | 3 | | | |
| | | | (d-4) | | | | 5 | | | |

TABLE 2-continued

| | Example | | | | | | |
|---|---|---|---|---|---|---|---|
| | 7 | 8 | 9 | 10 | 11 | 12 | 13 |
| (e) Deionized water | Balance | Balance | Balance | Balance | Balance | Balance | Balance |
| (f) (f-1) | | | | | | | |
| (f-2) | | | | | | | |
| (f-3) | 2.5 | 2.5 | 2.5 | | | | 2.5 |
| (g) Monoethanolamine | 3 | 3 | 3 | 2 | 4 | 2 | 1 |
| Polymer (1) | | | | 0.05 | | | |
| Fluorescent dye | | | | 0.2 | | | |
| Enzyme | | | | 1 | | | |
| Dye(1) | 0.0005 | 0.0005 | 0.0005 | 0.0005 | 0.0005 | 0.0005 | 0.0006 |
| Fragrance | 2 | 2 | 2 | 2 | 2 | 2 | 3 |
| Total | 100 | 100 | 100 | 100 | 100 | 100 | 100 |
| p1 + p2 in component (a) | 50 | 18 | 18 | 17 | 18 | 18 | 18 |
| q1 in component (a) | 2 | 2 | 2 | 2 | 2 | 2 | 2 |
| p1 + p2 + q1 in component (a) | 52 | 20 | 20 | 19 | 20 | 20 | 20 |
| Proportion of component (a-i) in component (a) (% by mol) | 99 | 79 | 90 | 87 | 86 | 86 | 86 |
| Proportion of component (a-ii) in component (a) (% by mol) | 99 | 95 | 75 | 93 | 92 | 92 | 92 |
| (a) + (b) + (c) (% by mass) | 55 | 55 | 55 | 58 | 56 | 71 | 51 |
| (a)/(b) (mass ratio) | 75.5/24.5 | 75.5/24.5 | 75.5/24.5 | 77/23 | 60/40 | 85/15 | 90/10 |
| [(a) + (b)]/(c) (mass ratio) | 89/11 | 89/11 | 89/11 | 90/10 | 89/11 | 91.5/8.5 | 80/20 |
| (1) Evaluation of detergency | ○ | ◎ | ◎ | ◎ | ◎ | ◎ | ○ |
| (2) Evaluation of storage stability | ○ | ○ | ○ | ○ | ○ | ○ | ○ |
| (3) Model evaluation of dissolution | ○ | ○ | ○ | ○ | ○ | ○ | ○ |
| (4) Evaluation of softening effect on fabric | ◎ | ◎ | ◎ | ◎ | ◎ | ◎ | ◎ |

TABLE 3

| | | | | Example | | |
|---|---|---|---|---|---|---|
| | | | | 14 | 15 | 16 |
| Liquid detergent composition | Component (% by mass) | (a) | (a-1) | 37 | 37 | 37 |
| | | | (a-2) | | | |
| | | | (a-3) | | | |
| | | | (a-4) | | | |
| | | | (a-5) | | | |
| | | | (a-6) | | | |
| | | (b) | (b-1-1) | 2 | 2 | 2 |
| | | | (b-2-1) | 10 | 10 | 10 |
| | | | (b-2-2) | | | |
| | | (c) | (c-1-1) | 7 | 7 | 7 |
| | | | (c-1-2) | | | |
| | | | (c-1-3) | | | |
| | | | (c-1-4) | | | |
| | | | (c-3-1) | | | |
| | | (d) | (d-1) | 13 | 13 | 13 |
| | | | (d-2) | | | |
| | | | (d-3) | | | |
| | | | (d-4) | | | |
| | | (e) | Deionized water | Balance | Balance | Balance |
| | | (f) | (f-1) | | | |
| | | | (f-2) | | | |
| | | | (f-3) | 2.5 | 2.5 | 2.5 |
| | | (g) | Monoethanolamine | 2.8 | 2.8 | 3 |
| | | Polymer (1) | | | | 3 |
| | | Fluorescent dye | | | | |
| | | Enzyme | | | | |
| | | Dye (1) | | | 0.0004 | 0.0005 |
| | | Dye (2) | | 0.00005 | 0.0001 | |
| | | sodium sulfite | | 0.1 | 0.1 | 0.1 |
| | | Para-toluenesulfonic acid | | 1 | 1 | 1 |
| | | Fragrance | | 1.5 | 1.5 | 1.5 |
| | | Total | | 100 | 100 | 100 |
| | p1 + p2 in component (a) | | | 18 | 18 | 18 |
| | q1 in component (a) | | | 2 | 2 | 2 |
| | p1 + p2 + q1 in component (a) | | | 20 | 20 | 20 |
| | Proportion of component (a-i) in component | | | 86 | 86 | 86 |

TABLE 3-continued

| | Example | | |
|---|---|---|---|
| | 14 | 15 | 16 |
| (a) (% by mol) Proportion of component (a-ii) in component (a) (% by mol) | 92 | 92 | 92 |
| (a) + (b) + (c) (% by mass) | 56 | 56 | 56 |
| (a)/(b) (mass ratio) | 75.5/24.5 | 75.5/24.5 | 75.5/24.5 |
| [(a) + (b)]/(c) (mass ratio) | 88/12 | 88/12 | 88/12 |
| (1) Evaluation of detergency | ◎ | ◎ | ◎ |
| (2) Evaluation of storage stability | ○ | ○ | ○ |
| (3) Model evaluation of dissolution | ○ | ○ | ○ |
| (4) Evaluation of softening effect on fabric | ◎ | ◎ | ◎ |

TABLE 4

| | | | | Comparative example | | | | |
|---|---|---|---|---|---|---|---|---|
| | | | | 1 | 2 | 3 | 4 | 5 |
| Liquid detergent composition | Component (% by mass) | (a) | (a-1) | 66 | 20 | | 37 | 37 |
| | | | (a-2) | | | | | |
| | | | (a-3) | | | | | |
| | | | (a-4) | | | | | |
| | | | (a-5) | | | | | |
| | | | (a-6) | | | | | |
| | | (b) | (b-1-1) | 2 | 2 | 2 | 2 | 2 |
| | | | (b-2-1) | 2 | 10 | 10 | 6 | 10 |
| | | | (b-2-2) | | | | | |
| | | (c) | (c-1-1) | 6 | 6 | 6 | 0.5 | 25 |
| | | | (c-1-2) | | | | | |
| | | | (c-1-3) | | | | | |
| | | | (c-1-4) | | | | | |
| | | | (c-3-1) | | | | | |
| | | (d) | (d-1) | 13 | 13 | 13 | 13 | 13 |
| | | | (d-2) | | | | | |
| | | | (d-3) | | | | | |
| | | | (d-4) | | | | | |
| | | (e) | Deionized water | Balance | Balance | Balance | Balance | Balance |
| | | (f) | (f-1) | | | | | |
| | | | (f-2) | | | 37 | | |
| | | | (f-3) | 2.5 | 2.5 | 2.5 | 2.5 | 2.5 |
| | | (g) | Monoethanolamine | 2 | 3 | 3 | 2 | 3 |
| | | | Polymer (1) | | | | | |
| | | | Fluorescent dye | | | | | |
| | | | Enzyme | | | | | |
| | | | Dye (1) | 0.0005 | 0.0005 | 0.0005 | 0.0005 | 0.0005 |
| | | | Fragrance | 2 | 2 | 2 | 2 | 2 |
| | | | Total | 100 | 100 | 100 | 100 | 100 |
| | p1 + p2 in component (a) | | | 18 | 18 | 60 | 18 | 18 |
| | q1 in component (a) | | | 2 | 2 | 2 | 2 | 2 |
| | p1 + p2 + q1 in component (a) | | | 20 | 20 | 62 | 20 | 20 |
| | Proportion of component (a-i) in component (a) (% by mol) | | | 86 | 86 | 99 | 86 | 86 |
| | Proportion of component (a-ii) in component (a) (% by mol) | | | 92 | 92 | 99 | 92 | 92 |
| | (a) + (b) + (c) (% by mass) | | | 76 | 38 | 18 | 45.5 | 74 |
| | (a)/(b) (mass ratio) | | | 94/6 | 62.5/37.5 | 0/100 | 82/18 | 75.5/24.5 |
| | [(a) + (b)]/(c) (mass ratio) | | | 92/8 | 84/16 | 68/32 | 99/1 | 66/34 |
| | (1) Evaluation of detergency | | | ◎ | X | X | ○ | X |
| | (2) Evaluation of strange stability | | | X | ○ | ○ | ○ | X |
| | (3) Model Evaluation of dissolution | | | X | ○ | X | ○ | X |
| | | | | XX | — | XX | — | XX |
| | (4) Evaluation of softening effect on fabric | | | Δ | ◎ | ○ | X | X |

Note: Components in tables are as follows. In Tables, constructions and ratios of a component (a) were shown on the supposition that (f-1) to (f-3) were included in the component (a). An amount of monoethanolamine of the component (g) was shown as it contained an alkanolamine derived from (b-2-2). In the description of the components below, ethylene oxide and propylene oxide are abbreviated as EO and PO, respectively. Surfactants of (a-1) to (a-5) may be derived from a saturated linear primary alcohol, and the surfactant of (a-6) may be derived from a saturated linear secondary alcohol.

Component (a)

(a-1): a block adduct of EO, PO, and EO in this order in average amounts of 9 mol, 2 mol, and 9 mol, respectively, to a primary alcohol having 10 to 14 carbon atoms.

(a-2): a block adduct of EO, PO, and EO in this order in average amounts of 7 mol, 2 mol, and 7 mol, respectively, to a primary alcohol having 10 to 14 carbon atoms.

(a-3): a block adduct of EO, PO, and EO in this order in average amounts of 25 mol, 2 mol, and 25 mol, respectively, to a primary alcohol having 10 to 14 carbon atoms.

(a-4): a block adduct of EO, PO, and EO in this order in average amounts of 4 mol, 2 mol, and 14 mol, respectively, to a primary alcohol having 10 to 14 carbon atoms.

(a-5): a block adduct of EO, PO, and EO in this order in average amounts of 14 mol, 2 mol, and 4 mol, respectively, to a primary alcohol having 10 to 14 carbon atoms.

(a-6): a block adduct of EO, PO, and EO in this order in average amounts of 9 mol, 2 mol, and 9 mol, respectively, to a secondary alcohol having 12 to 14 carbon atoms.

Component (b)

(b-1-1): Lunac MY-98 (trade name; average carbon number 14.0) (palm oil-based fatty acid; manufactured by Kao Corporation)

(b-2-1): alkylbenzenesulfonic acid comprising a linear alkyl group having 10 to 14 carbon toms (average carbon number 11.7)

(b-2-2): polyoxyethylene alkyl ether sulfuric acid salt (linear alkyl having 10 to 14 carbon atoms, average addition mole number of PO: 1, average addition mole number of EO: 3, monoethanolamine salt, average carbon number 12.3)

(c-1-1-1); linear alkyl-(carbon number 12)-trimethylammonium chloride (c-1-1-2); linear alkyl-(carbon number 16)-trimethylammonium chloride (c-1-1-3); linear alkyl-(carbon number 12)-trimethylammonium ethyl sulfate (c-1-1-4); linear alkyl-(carbon number 12)-trimethylammonium methyl sulfate (c-1-3-1); Sanisol C (trade name) (linear alkyl-(mixture of those having 12 to 16 carbon atoms)-benzyldimethylammonium chloride; manufactured by Kao Corporation)

Component (d)

(d-1): diethylene glycol monobutyl ether (d-2): propylene glycol (d-3): ethylene glycol monophenyl ether (d-4): ethanol Component (f)

(f-1): a block adduct of EO, PO, and EO in this order in average amounts of 30 mol, 2 mol, and 30 mol, respectively, to a primary alcohol having 10 to 14 carbon atoms.

(f-2): Emulgen 105 [trade name, polyoxyethylene(4)lauryl ether (Kao Corporation)]

(Others)

Polymer (1): polymer produced according to a method described in JP-A10-60476, p. 4, paragraph 0020, Synthesis Example 1 fluorescent dye: Tinopal CBS-X (trade name) (Ciba Specialty Chemicals Inc.)

enzyme: Everlase 16.0L-EX (trade name) (protease, manufactured by Novozymes)

Dye (1): Green No. 202

Dye (2): Yellow No. 203

The invention claimed is:

1. A liquid detergent composition, comprising components (a) to (d), wherein the total content of the components (a) to (c), (a)+(b)+(c), is from 49 to 80% by mass; a mass ratio of the components (a) to (b), (a)/(b), is from 50/50 to 90/10; a mass ratio of the total of the components (a) and (b) to the component (c), [(a)+(b))/(c), is from 90/10 to 70/30, and a mass ratio of the total of the components (a), (b), and (c) to the component (d), [(a)+(b)+(c)]/(d), is from 85/15 to 65/35:

component (a): from 15 to 60% by mass of a nonionic surfactant produced by adding p1 mol of ethylene oxide to a compound represented by the formula R—OH, wherein R represents a hydrocarbon group having from 8 to 18 carbon atoms, then adding q1 mol of an alkylene oxide having from 3 to 5 carbon atoms, and then adding p2 mol of ethylene oxide, wherein p1 is a number of from 3 to 30, q1 is a number of from 1 to 5, and p1+p2 is from 16 to 50, component (b): an anionic surfactant, component (c): a cationic surfactant, wherein the component (c) is a quaternary ammonium salt represented by the formula (c-1):

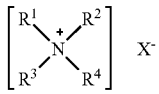

(c-1)

wherein $R^1$ represents a hydrocarbon group having from 6 to 22 carbon atoms and optionally contains a $-(AO)_s-$ group, wherein AO represents an oxyethylene group or oxypropylene group, s represents an average addition mole number of AO of from 0.1 to 10;

$R^2$, $R^3$, and $R^4$ each independently represents a methyl group, an ethyl group, a benzyl group or a hydroxyalkyl group having from 1 to 3 carbon atoms; and X represents a halogen atom, $CH_3SO_4$, or $CH_3CH_2SO_4$, component (d): from 13 to 40% by mass of a water-miscible organic solvent.

2. The liquid detergent composition according to claim 1, wherein the alkylene oxide having from 3 to 5 carbon atoms is propylene oxide.

3. The liquid detergent composition according to claim 1, wherein the component (b) comprises (b-1) a carboxylate anionic surfactant and (b-2) a sulfonic acid or sulfate ester anionic surfactant.

4. A method for washing a fiber product with the liquid detergent composition according to claim 1 wherein said method comprises contacting said fiber product with the liquid detergent composition.

5. The liquid detergent composition according to claim 1, wherein R is a linear alkyl group.

6. The liquid detergent composition according to claim 1, which further comprises water as component (e) in the amount of from 5 to 40% by mass.

7. The liquid detergent composition according to claim 1, which further comprises an alkaline agent as component (g) in the amount of from 0.5 to 8% by mass.

8. The liquid detergent composition according to claim 7, wherein component (g) is an alkanolamine.

9. The liquid detergent composition according to claim 8, wherein the alkanolamine is monoethanolamine.

10. The liquid detergent composition according to claim 6, which further comprises an alkaline agent as component (g) in the amount of from 0.5 to 8% by mass.

11. The liquid detergent composition according to claim 10, wherein the alkaline agent is an alkanolamine.

12. The liquid detergent composition according to claim 11, wherein the alkanolamine is monoethanolamine.

13. The liquid detergent composition according to claim 1, wherein the water-miscible organic solvent (d) is at least one member selected from the group consisting of an alkanol, a glycol, an alkyl ether, and an aromatic ether.

14. The liquid detergent composition according to claim 13, wherein component (d) is at least one member selected from the group consisting of ethanol, propylene glycol, diethylene glycol monobutyl ether, 2-phenoxyethanol, diethylene glycol monophenyl ether, and triethylene glycol monophenyl ether.

15. The liquid detergent composition according to claim 1, wherein gelation does not occur in an operation of diluting the composition of from 5 to 40° C. with water of 5° C. by more than 0 time to 100 times.

16. The liquid detergent composition according to claim 6, wherein gelation does not occur in an operation of diluting the composition of from 5 to 40° C. with water of 5° C. by more than 0 time to 100 times.

17. A detergent composition, comprising components (a) to (e) and component (g), wherein the total content of the components (a) to (c), (a)+(b)+(c), is from 49 to 80% by mass; the mass ratio of the components (a) to (b), (a)/(b), is from 50/50 to 90/10; and the mass ratio of the total of components (a) and (b) to the component (c), (a)+(b)]/(c), is from 90/10 to 70/30:

component (a): from 15 to 60% by mass of a nonionic surfactant produced by adding p1 mol of ethylene oxide to a compound represented by the formula R—OH, wherein R represents hydrocarbon group having from 8 to 18 carbon atoms, then adding q1 mol of an alkylene oxide having from 3 to 5 carbon atoms, and then adding p2 mol of ethylene oxide, wherein p1 is a number of from 3 to 30, q1 is a number of from 1 to 5, and p1+p2 is from 16 to 50, component (b): an anionic surfactant, component (c): a cationic surfactant, wherein the component (c) is a quaternary ammonium salt represented by the formula (c-1):

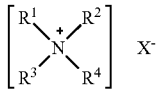

(c-1)

wherein $R^1$ represents a hydrocarbon group having from 6 to 22 carbon atoms and optionally contains a $-(AO)_s—$ group, wherein AO represents an oxyethylene group or oxypropylene group, s represents an average addition mole number of AO of from 0.1 to 10;

$R^2$, $R^3$, and $R^4$ each independently represents a methyl group, an ethyl group, a benzyl group or a hydroxyalkyl group having from 1 to 3 carbon atoms; and X represents a halogen atom, $CH_3SO_4$, or $CH_3CH_7SO_4$, component (d): from 13 to 40% by mass of a water-miscible organic solvent, component (e): from 5 to 40% by mass of water and component (g): from 0.5 to 8% by mass of an alkaline agent.

18. The liquid detergent composition according to claim 17, wherein component (g) is an alkanolamine.

19. The liquid detergent composition according to claim 17, wherein gelation does not occur in an operation of diluting the composition of from 5 to 40° C. with water of 5° C. by more than 0 time to 100 times.

* * * * *